US009944476B2

(12) United States Patent
Omori

(10) Patent No.: US 9,944,476 B2
(45) Date of Patent: Apr. 17, 2018

(54) SHEET LOADING DEVICE

(71) Applicant: RISO KAGAKU CORPORATION, Tokyo (JP)

(72) Inventor: Masaru Omori, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/485,477

(22) Filed: Apr. 12, 2017

(65) Prior Publication Data

US 2017/0334670 A1 Nov. 23, 2017

(30) Foreign Application Priority Data

May 20, 2016 (JP) ..... 2016-101075

(51) Int. Cl.
*B65H 1/26* (2006.01)

(52) U.S. Cl.
CPC ..... *B65H 1/266* (2013.01); *B65H 2402/31* (2013.01); *B65H 2402/35* (2013.01); *B65H 2402/441* (2013.01); *B65H 2402/45* (2013.01); *B65H 2405/354* (2013.01)

(58) Field of Classification Search
CPC ..... B65H 1/266; B65H 2402/31; B65H 2402/35; B65H 2402/441; B65H 2402/45; B65H 2405/354; E05D 3/02; E05D 5/0276; Y10T 16/5409; Y10T 16/544; Y10T 16/5444; Y10T 16/5445
See application file for complete search history.

(56) References Cited

FOREIGN PATENT DOCUMENTS

JP 08-208096 8/1996

*Primary Examiner* — Michael C McCullough
(74) *Attorney, Agent, or Firm* — Greenblum & Bernstein, P.L.C.

(57) ABSTRACT

The rotational pin and the lock pin are laterally provided in the right and left first brackets that are fixed to the right and left side surfaces of the sheet loading tray respectively, and furthermore, the right and left second brackets are fixed to the right and left of the one side surfaces of the casing. When the sheet loading tray reaches the sheet loading position, the lock pin is made to enter the sheet loading tray lock groove formed on the right and left second brackets to thereby lock and hold the sheet loading tray at the sheet loading tray storage position, along with an action of rotating the sheet loading tray about the rotational pin fitting into the sheet loading tray support groove formed on the right and left second brackets from the sheet loading position to the sheet loading tray storage position.

2 Claims, 9 Drawing Sheets

SHEET LOADING DEVICE

BACKGROUND

1. Technical Field

The present invention relates to a sheet loading device applied to an image forming apparatus and including a sheet loading tray on which a plurality of sheets is loaded.

2. Related Art

Generally, an image forming apparatus such as a printing apparatus that prints images and characters on sheets or a copy machine that copies images and characters thereon includes a sheet loading device including a sheet loading tray on which a plurality of sheets are loaded.

This type of a sheet loading device is used as a paper feed device that feeds, one by one, a plurality of sheets loaded on the sheet loading tray to the image forming apparatus. Alternatively, the sheet loading device is used as a paper discharge device that sequentially loads, on the sheet loading tray, sheets having the images formed which have been discharged from the image forming apparatus.

An example of the sheet loading device includes a paper discharge device in a stencil printing machine using the sheet loading tray as a paper receiving tray disclosed in Patent Literature 1 (Japanese Patent Application Publication No. 08-208096).

The paper discharge device in the stencil printing machine disclosed in Patent Literature 1 is rotatably mounted with a paper receiving tray (sheet loading tray) on a side of a one side surface of a casing between a sheet loading position (inclined position) and a paper receiving tray storage position (erected position).

When the paper receiving tray is located at the sheet loading position, the paper receiving tray is inclined toward an outside from the one side surface of the casing of the stencil printing machine (described as a printing unit in Patent Literature 1) to thereby allow loading of a plurality of sheets. When the paper receiving tray is located at the paper receiving tray storage position, the paper receiving tray is in a state of being erected along the one side surface of the casing to be stored.

Furthermore, the paper receiving tray is held in a state of being erected with a magnet mounted on the side of the one side surface of the casing at the paper receiving tray storage position. The paper receiving tray is detachable from the side of the one side surface of the casing, with the plurality of sheets loaded at the sheet loading position.

According to the paper discharge device included in the stencil printing machine configured as described above, there is no generation of offset on each sheet, since the paper receiving tray is removed from the casing with a great number of printed sheets loaded and is moved to other storage place, and thus pressure caused by operator's hands and fingers onto printed matter cannot be applied during movement.

Furthermore, a plurality of paper receiving trays is prepared in advance and a new, empty paper receiving tray is mounted to the one side surface of the casing in place of the removed paper receiving tray. Thus, next printing can be instantly started, and the printing can be efficiently performed by elimination of a waste of printing time due to leaving the printed matters behind.

SUMMARY

The paper discharge device included in the stencil printing machine described in the Patent Literature 1 uses a magnet as a holding member that holds the paper receiving tray in a state (a state where the paper receiving tray is at the paper receiving tray storage position (erected position)) where the paper receiving tray (sheet loading tray) is erected along the one side surface of the casing.

However, a holding force of the magnet is not stable and, thus, when the holding force thereof is weak, there is a case where the paper receiving tray suddenly falls down by a slight contact, thereby causing danger. Furthermore, there is also a case where the paper receiving tray or parts around it may be damaged by the force of falling down.

On the other hand, when the holding force of the magnet is strong, a great force is required when the paper receiving tray is removed from the casing. Therefore, a dangerous case may occur since an excessively strong force is given when the force is applied.

Accordingly, an object of the present invention is to provide a sheet loading device in which a sheet loading tray that loads a plurality of sheets is rotatably mounted between a sheet loading position and a sheet loading tray storage position on a side of a one side surface of a casing of an image forming apparatus. Further, when the sheet loading tray is configured to be detachable from the side of the one side surface of the casing at the sheet loading position, the sheet loading tray can be reliably locked and held without the use of a magnet in a state where the sheet loading tray is erected along the one side surface of the casing at the sheet loading tray storage position.

The present invention has been made in consideration of the problem described above. A first invention is a sheet loading device in which in which a sheet loading tray that loads a plurality of sheets, between a sheet loading position where the sheet loading tray is inclined outwardly from a one side surface of a casing of an image forming apparatus to load the sheet and a sheet loading tray storage position where the sheet loading tray is erected along the one side surface to be stored, is rotatably mounted on a side of the one side surface of the casing, and furthermore, the sheet loading tray is detachable from the side of the one side surface at the sheet loading position, the sheet loading device comprising:

right and left first brackets whose each side of one-end parts is fixed to each outside of right and left side surfaces on a side of a front side surface of the sheet loading tray facing the one side surface of the casing, and whose each side of other-end parts protrudes toward the one side surface thereof;

a lock pin laterally provided on each side of one-end parts of the right and left first brackets;

a rotational pin laterally provided on each side of other-end parts of the right and left first brackets right and left second brackets whose each side of one-end parts is fixed to each of right and left one side surfaces of the casing, and whose each side of other-end parts protrudes toward each of right and left side surface sides of the sheet loading tray;

a sheet loading tray lock groove into/from which the each lock pin is inserted/detached with an upper part close to each side of one-end parts being opened in an upper part of each side of the other end parts of the right and left second brackets, and a sheet loading tray lock groove into/from which the each rotational pin is inserted/detached with an upper part away from each side of one-end parts being opened in an upper part of each side of the other end parts of the right and left second brackets, wherein, when the sheet loading tray reaches the sheet loading position, the lock pin is made to enter the sheet loading tray lock groove formed on the right and left second brackets to lock and hold the sheet loading tray at the sheet loading tray storage position, along with an action of rotating the sheet loading tray about the rotational pin fitting into the sheet loading tray support groove formed on the right and left second brackets from the sheet loading position to the sheet loading tray storage position.

Furthermore, a second invention is the sheet loading device of the first invention, wherein, between the sheet loading tray support groove and the sheet loading tray lock groove, the right and left second brackets are formed with each curved cam part on which the lock pin slides along with an action of rotating the sheet loading tray from the sheet loading position to the sheet loading tray storage position.

DETAILED DESCRIPTION

Hereinafter, an embodiment of the sheet loading device according to the present invention will be described in detail with reference to FIGS. 1 to 10.

The sheet loading device according to the present invention is applied to printing apparatuses that print images and characters on sheets, and image forming apparatuses such as copy machines that copy images and characters thereon.

The sheet loading device according to the present invention is used as a paper feed device that feeds, one by one, a plurality of sheets loaded on the sheet loading tray into the image forming apparatus. Alternatively, the sheet loading device is used as a paper discharge device that sequentially loads, on the sheet loading tray, sheets having images formed which have been discharged from the image forming apparatus.

Hereinafter, there will be described, with reference to FIG. 1, a case where the sheet loading device according to the present invention is used as a paper discharge device in the image forming apparatus, and the description will be omitted in a case where the sheet loading device is used as the paper discharge device having the substantially same configuration as that of the paper discharge device.

Figure 1:
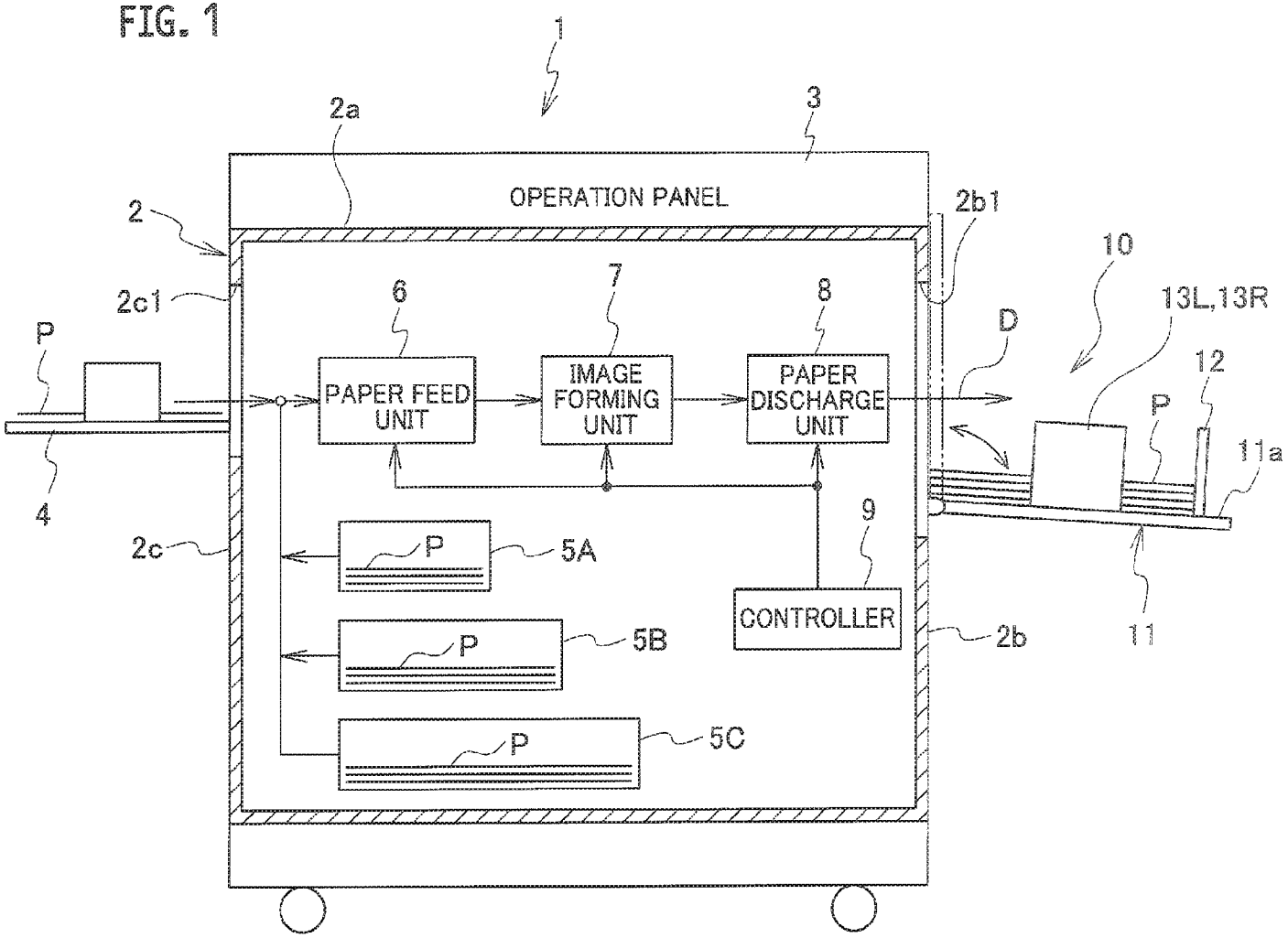
FIG. 1 is a configuration diagram illustrating an entire configuration of an image forming apparatus applying the sheet loading device according to the present invention.

FIG. 1 illustrates an entire configuration of the image forming apparatus applying the sheet loading device according to the present invention.

First, as illustrated in FIG. 1, in an image forming apparatus 1 applying a sheet loading device 10 according to the present invention, a casing 2 is formed in a box-like shape, and an operation panel 3 that operates the image forming apparatus 1 is provided on a top face 2*a* of the casing 2.

In the casing 2, a first opening part 2*b*1 is opened at an upper site of a one side surface 2*b* serving as one of side surfaces on which the sheet loading device 10 according to the present invention is provided. A sheet loading tray 11 that loads a plurality of sheets P is rotatably (openably and closably) and detachably mounted facing the first opening part 2*b* 1 in a state of protruding to the outside of the one side surface 2*b* of the casing 2.

Note that, in the following description, "front, back, right and left" are defined as those on the basis of a direction in which a side of the one side surface 2*b* of the casing 2 is viewed from a side of the sheet loading device 10. In other words, "front" and "back" mean "forward" and "backward", respectively, in a direction toward the side of the one side surface 2*b* of the casing 2 from the side of the sheet loading device 10. Furthermore, "right" and "left" mean "right side" and "left side" viewed from a front, respectively, when the side of the one side surface 2*b* of the casing 2 is viewed from the side of the sheet loading device 10.

A second opening part 2*c*1 is opened at an upper site of the other side surface 2*c* of the casing 2, which faces the one side surface 2*b* with the casing 2 therebetween. An external paper feed tray 4 that loads the sheet P for manual paper feed is mounted facing the second opening part 2*c*1 as necessary in a state of protruding outwardly from the other side surface 2*c*. Note that, in a substantially similar manner to the sheet loading device 10 according to the present invention, the external paper feed tray 4 may be rotatably (openably and closably) provided on the other side surface 2*c* of the casing 2. Furthermore, the external paper feed tray 4 may be detachably provided on the other side surface 2*c* of the casing 2.

Furthermore, the plurality of internal paper feed trays 5A to 5C is provided corresponding to an outer size of the sheet P at a side of the other side surface 2*c* in the casing 2. The internal paper feed trays 5A to 5C are provided such that they can be pulled out of the casing 2.

Moreover, the casing 2 is provided with a paper feed unit 6 that selectively feeds, one by one, the sheets P on the external paper feed tray 4 or the sheets P in the plurality of internal paper feed trays 5A to 5C, an image forming unit 7 that forms the image on the sheets P conveyed from the paper feed unit 6, a paper discharge unit 8 that discharges the sheets P which have been processed to thereby be formed with the image in the image forming unit 7, and a controller 9 that totally controls the image forming apparatus 1.

In addition, the sheet loading tray 11 mounted outside the one side surface 2*b* of the casing 2 functions as a paper receiving tray that loads the sheets P with the image formed which have discharged from the paper discharge unit 8.

An end fence plate 12 that restricts a leading end of the sheet P in a sheet discharge direction D is provided movably, on the upper surface 11*a* of the sheet loading tray 11 (paper receiving tray), in the sheet discharge direction D depending on a length of the sheet P and foldably toward an inside when the sheet loading tray 11 is stored.

Furthermore, a pair of right and left side fence plates 13R and 13L that restrict both side ends of the sheet P in a width direction thereof are provided movably, on the upper surface 11*a* of the sheet loading tray 11, in the width direction of the sheet orthogonal to the sheet discharge direction D depending on a width dimension of the sheets P, and foldably inwardly with each other when the sheet loading tray 11 is stored.

Moreover, the sheet loading tray 11 is rotatably mounted on the side of the one side surface 2*b* of the casing 2 between the sheet loading position (inclined position) where the sheet loading tray 11 is inclined up to an angle with which the sheet loading tray is located slightly lower than a horizontal line outwardly from the one side surface 2*b* of the casing 2 and loads the plurality of sheets P, and the sheet loading tray storage position (erected position) where the sheet loading tray 11 is substantially vertically erected along the one side surface 2*b* of the casing 2. Furthermore, the sheet loading tray 11 is set detachable from the one side surface 2*b* of the casing 2, with the sheets P loaded at the sheet loading position.

Here, a configuration of the sheet loading device 10 according to the present invention will be described by the use of FIGS. 2 to 4 and FIGS. 5A, 5B, 6A, and 6B. Note that, in FIGS. 2 to 4, the end fence plate 12 and a pair of right and left side fence plates 13R and 13L provided on the sheet loading tray 11 illustrated in FIG. 1 are not illustrated.

Figure 2:
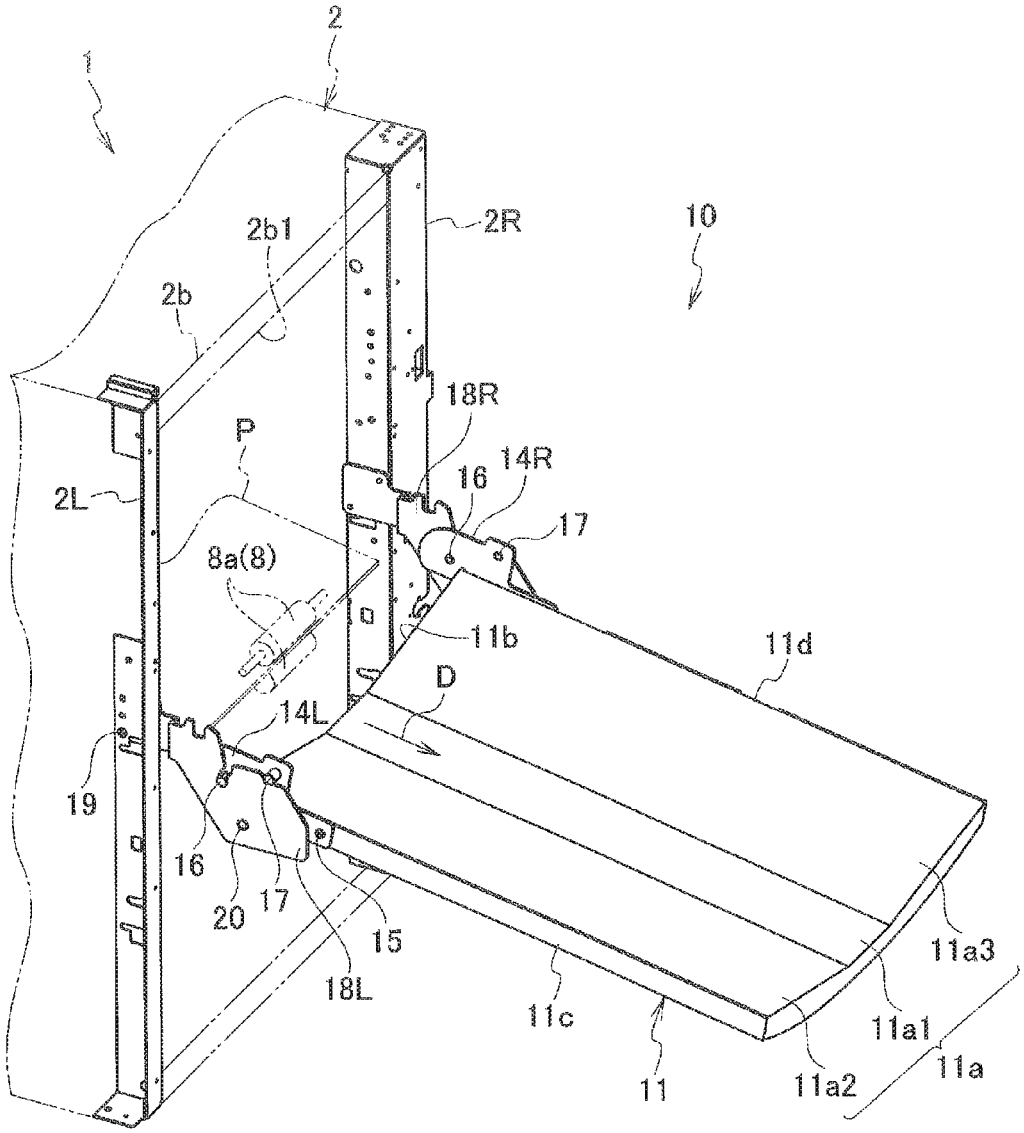
FIG. 2 is a perspective view illustrating a sheet loading device according to the present invention in a state where the sheet loading tray is inclined outwardly from a one side surface of a casing of the image forming apparatus, and reaches a sheet loading position where a plurality of sheets is loaded.
Figure 3:
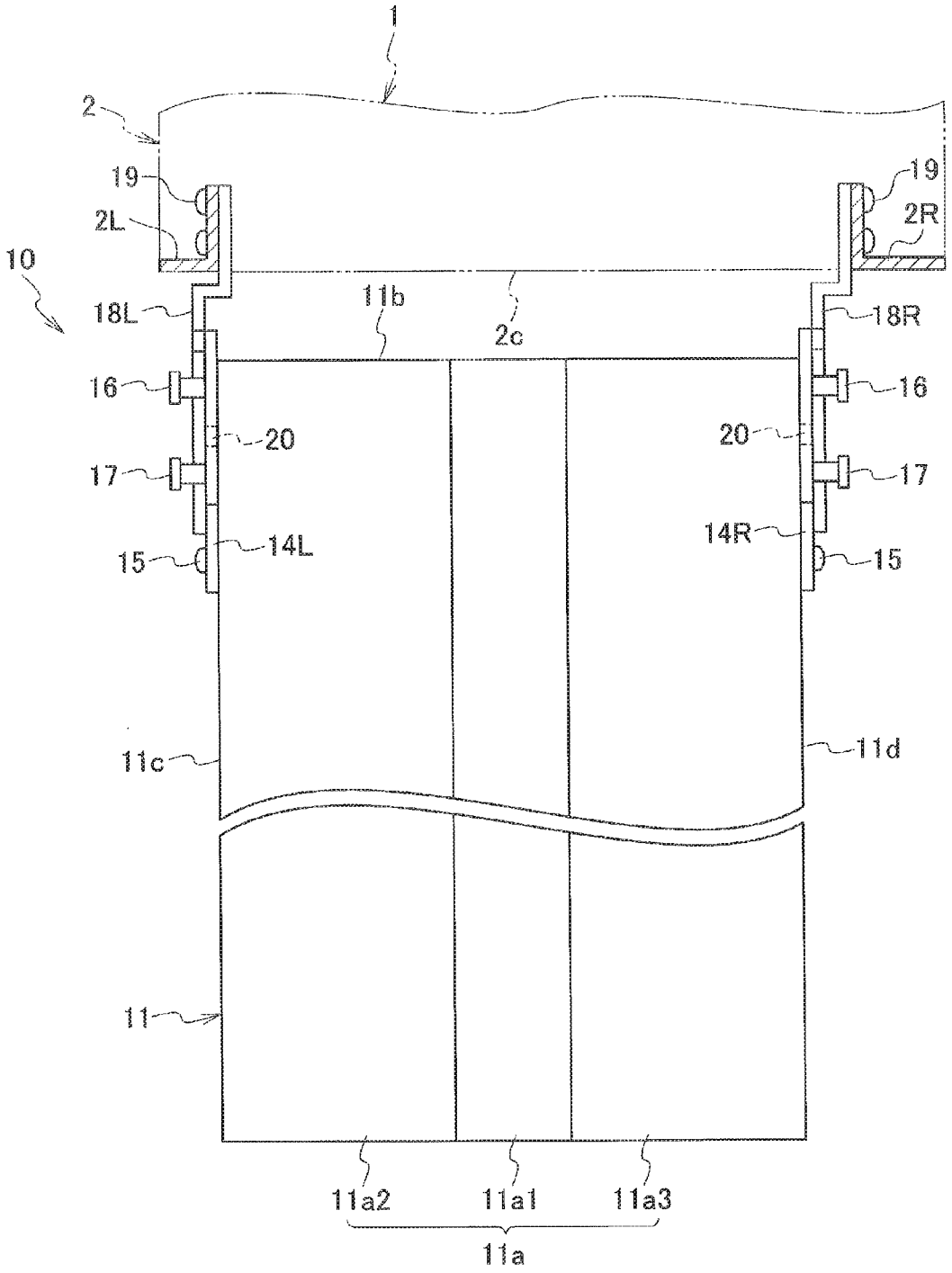
FIG. 3 is a top plan view of the sheet loading device according to the present invention illustrating a state where the sheet loading tray is inclined outwardly from the one side surface of the casing of the image forming apparatus, and reaches the sheet loading position where the plurality of sheets is loaded.

FIGS. 2 and 3 illustrate a state where the sheet loading tray 11 is inclined outwardly from the one side surface 2*b* of the casing 2 of the image forming apparatus 1 to thereby reach the sheet loading position where the plurality of sheets is loaded.

At this sheet loading position, the sheet loading tray 11 rotatably supported at a substantially intermediate site of the one side surface 2*b* of the casing 2 in a height direction is inclined at a predetermined angle (substantially 100 degrees) to the one side surface 2*b* of the casing 2.

Then, the sheets P discharged toward the sheet discharge direction D by a pair of paper discharge rollers 8*a* of the paper discharge unit 8 provided in the casing 2 are sequentially loaded on the upper surface 11*a* of the sheet loading tray 11.

Furthermore, as described below, since the sheet loading tray 11 is detachably supported on the one side surface 2*b* of the casing 2 at this sheet loading position, the sheet loading tray 11 can be removed from the side of the one side surface 2*b* of the casing 2, with the plurality of sheets P loaded on the sheet loading tray 11.

Figure 4:
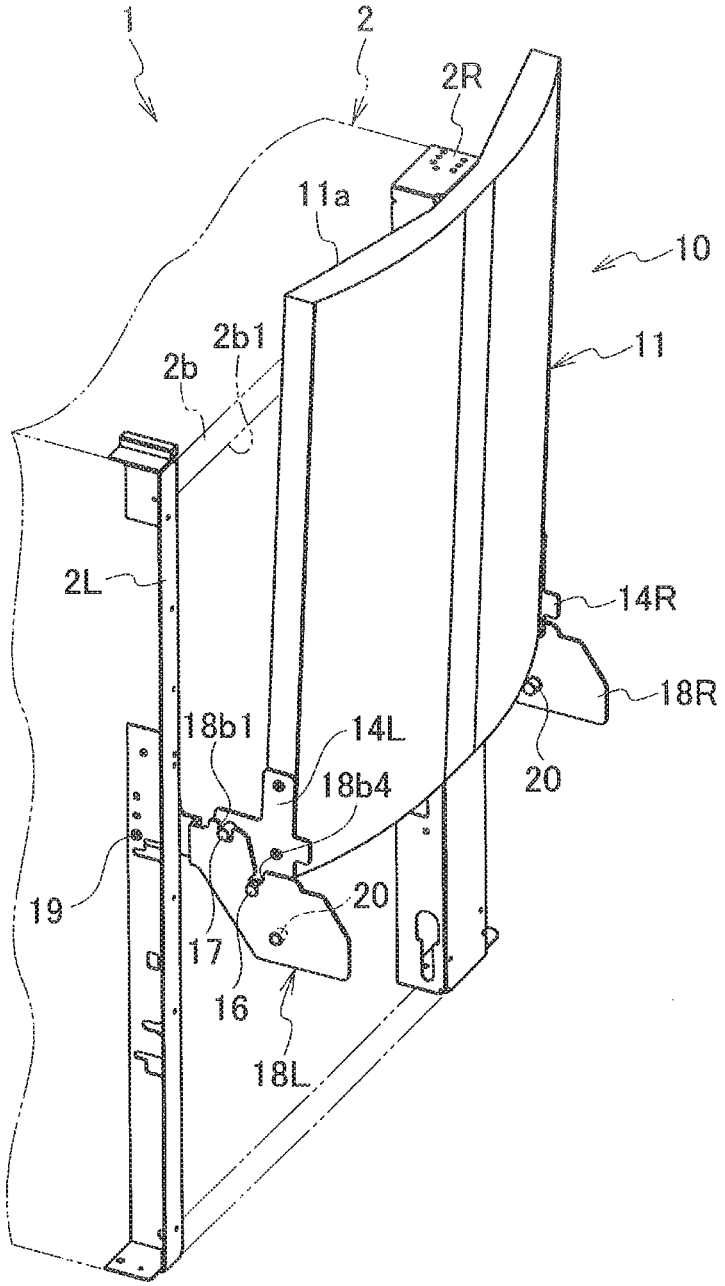
FIG. 4 is a perspective view of the sheet loading device according to the present invention illustrating a state where the sheet loading tray is erected along the one side surface of the casing of the image forming apparatus, and reaches a sheet loading tray storage position where the sheet loading tray is stored.

On the other hand, FIG. 4 illustrates a state where the sheet loading tray 11 is erected along the one side surface 2*b* of the casing 2 of the image forming apparatus 1 and reaches the sheet loading tray storage position where the sheet loading tray 11 is stored.

At this sheet loading tray storage position, the end fence plate 12 and the pair of the right and left side fence plates 13R and 13L which are provided on the sheet loading tray 11 can be each folded inwardly to thereby be capable of being stored in the first opening part 2*b*1 opened in the one side surface 2*b* of the casing 2.

Then, the side of the upper surface 11*a* of the sheet loading tray 11 and the one side surface 2*b* of the casing 2 are made to face each other, and thus the sheet loading tray 11 is substantially vertically erected.

Therefore, at the time of conveyance of the image forming apparatus 1, or at the time of non-use when the sheet loading tray 11 loads the plurality of sheets P, the sheet loading tray 11 does not become obstructive, and thus the sheet loading device 10 can be made compact.

Returning to FIGS. 2 and 3, the sheet loading tray 11 that loads the plurality of sheets P is formed in a rectangular shape by the use of a resin material having rigidity.

Here, on the upper surface 11*a* of the sheet loading tray 11, a flat surface 11*a*1 is formed at a center in the sheet width direction along the sheet discharge direction D, and further, inclined surfaces 11*a*2 and 11*a*3 are inclined upward along the sheet width direction at both right and left sides of the flat surface 11*a*1 to be formed symmetrical bilaterally.

Then, right and left side end parts in the sheet width direction of the sheet P loaded on the upper surface 11*a* of the sheet loading tray 11 are lifted by the flat surface 11*a*1 and the right and left inclined surfaces 11*a*3, 11*a*2 to be stiffened.

Furthermore, the sheet loading tray 11 is mounted with right and left first brackets 14R and 14L. The right and left first brackets 14R and 14L are mounted respectively at positions of right and left side surfaces 11*d* and 11*c* of the sheet loading tray 11, and the positions are located on a side of a front side surface 11*b* facing the one side surface 2*b* of the casing 2. Each side of one-end parts of the right and left first brackets 14R and 14L is fixed to the sheet loading tray 11 by the use of a screw 15, and further, each side of other-end parts of the right and left first brackets 14R and 14L protrudes toward the side of the one side surface 2*b* of the casing 2.

Figure 5A:
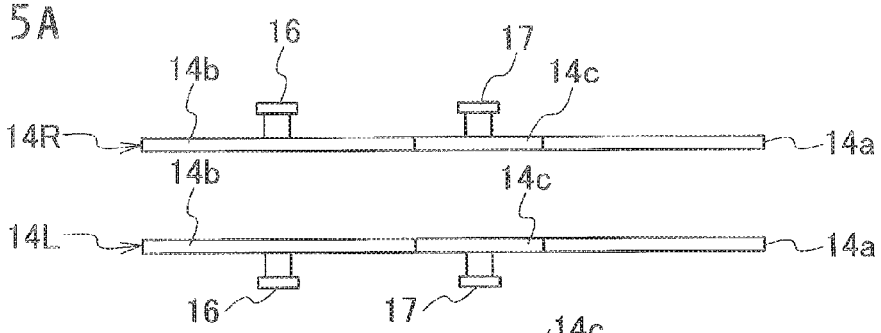
FIG. 5A is a top plan view illustrating right and left first brackets to be mounted on right and left side surfaces of the sheet loading tray, respectively.
Figure 5B:
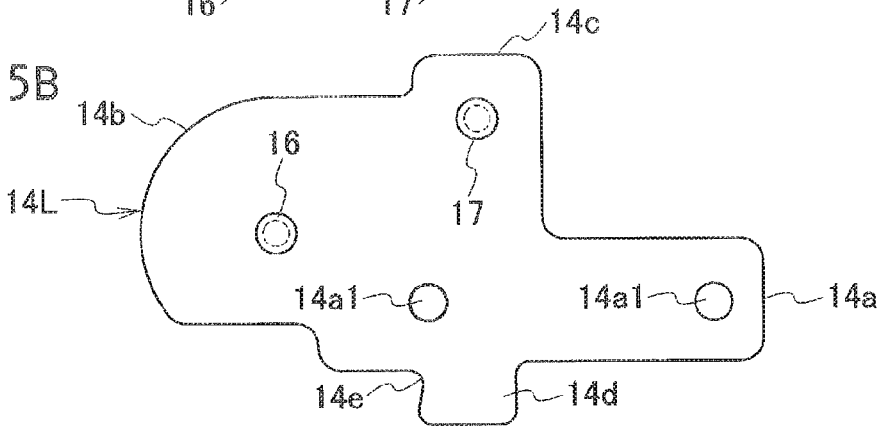
FIG. 5B is a side elevation view illustrating right and left first brackets to be mounted on the right and left side surfaces of the sheet loading tray, respectively.

The right and left first brackets 14R and 14L described above are formed in a plate-like shape by the use of a plate material as illustrated in enlarged views in FIGS. 5A and 5B.

Moreover, the right and left first brackets 14R and 14L are formed such that each side of one-end parts 14*a* mounted on the right and left side surfaces 11*d* and 11*c* of the sheet loading tray 11 has substantially the same height dimension as those of the right and left side surfaces 11*d* and 11*c*, and dimension of each side of the one-end parts 14*a* in a longitudinal direction is formed longer. In addition, a screw mounting holes 14*a*1 through which the screws 15 (FIGS. 2 and 3) are mounted is formed at two places so as to penetrate into each side of the one-end parts 14*a* and each intermediate lower part 14*d* described below.

Furthermore, the right and left first brackets 14R and 14L are formed such that each side of other-end parts 14*b* opposite to each side of the one-end parts 14*a* is higher than each side of the one-end parts 14*a*, and a leading end of each side of the other-end parts 14*b* is formed in the R-like shape. In addition, a rotational pin 16 with leading end flange part is laterally provided, outwardly in each side of the other-end parts 14*b*.

Moreover, the right and left first brackets 14R and 14L are formed such that each of intermediate upper parts 14*c* between each side of the one-end parts 14*a* and each side of the other-end parts 14*b* is slightly higher than each side of the other-end parts 14*b*, and dimension of the each of the intermediate upper parts 14*c* in the longitudinal direction is shorter than each side of the other-end parts 14*b*. In addition, a lock pin 17 with leading end flange part is laterally provided, outwardly in each of the intermediate upper parts 14*c*.

Furthermore, in the right and left first brackets 14R and 14L, each of intermediate lower parts 14*d* between each side of the one-end parts 14*a* and each side of the other-end parts 14*b* protrudes more downwardly than each side of the one-end parts 14*a* and each side of the other-end parts 14*b*. There is formed, in a concave shape, a concave part 14*e* for engaging a stopper pin which engages with each stopper pin 20 laterally provided in right and left second brackets 18R and 18L (FIGS. 2, 3, 6A, and 6B) described below on a side facing the one side surface 2*b* of the casing 2 of the intermediate lower part 14*d*.

Then, the right and left first brackets 14R and 14L use the same components to reduce the number of components. However, the rotational pin 16 and the lock pin 17 are laterally provided, outwardly, in a horizontally symmetrical manner, and thus the right and left first brackets 14R and 14L are fixed in the horizontally symmetrical manner on the right and left side surfaces 11*d* and 11*c* of the sheet loading tray 11.

Returning to FIGS. 2 and 3 again, in the right and the left of one side surface 2*b* of the casing 2 in the sheet width direction, the sheet right and left frame members 2R and 2L are vertically provided in a state where the right and left frame members 2R and 2L are apart from each other slightly wider than a width dimension of the sheet P in the maximum size.

Then, each one-end side of the right and left second brackets 18R and 18L are fixed by the use of a screw 19 on each inside side surface of the right and left frame members 2R and 2L at a substantially intermediate site in the height direction, and furthermore, each other-end side of the right and left second brackets 18R and 18L protrudes toward each side of right and left side surfaces 11*d* and 11*c* of the sheet loading tray 11.

Figure 6A:
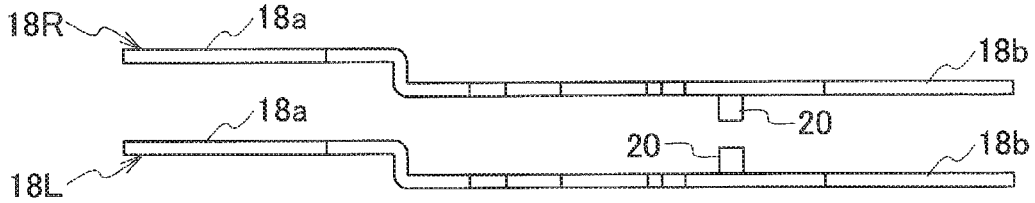
FIG. 6A is a top plan view illustrating right and left second brackets to be mounted on the right and the left of a side of a one side surface of a casing in an image forming apparatus, respectively.
Figure 6B:
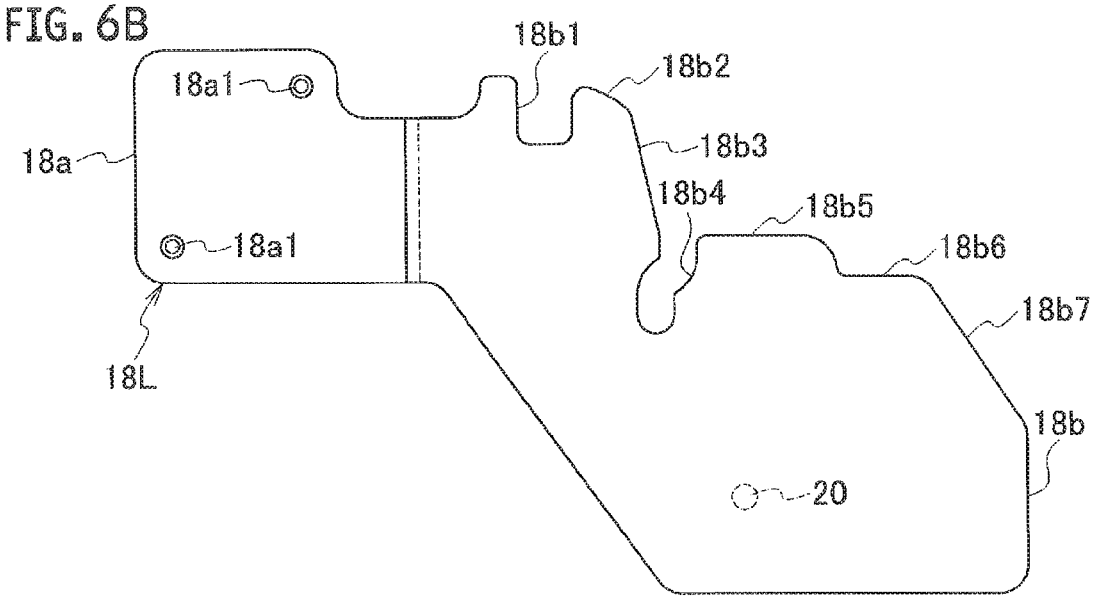
FIG. 6B is a side elevational view illustrating the right and left second brackets to be mounted on the right and the left of the side of the one side surface of the casing in the image forming apparatus, respectively.

The right and left second brackets 18R, 18L described above are formed by folding a sheet metal material used, as illustrated in an enlargement view in FIGS. 6A, 6B.

Furthermore, the right and left second brackets 18R and 18L are formed such that each side of one-end parts 18*a* mounted on each inside surface at a substantially intermediate site in a height direction of the right and left frame members 2R and 2L is formed to be a square flat surface, and furthermore, a screw tap 18*a*1, to which screws 19 (FIGS. 2 and 3) are mounted, is formed at two places in each side of the one-end parts 18*a*.

Moreover, the right and left second brackets 18R and 18L are folded such that each side of the other-end parts 18*b* opposite to each side of the one-end parts 18*a* protrudes one step more rightward or leftward than each side of the one-end parts 18*a*, and furthermore, they are formed such that each side of the other-end parts 18*b* in the height direction is larger than each side of the one-end parts 18*a*, and longer than each side of the one-end parts 18*a* in the longitudinal direction to thereby be formed in the plate-like shape. In addition, the upper part of each side of the other-end parts 18*b* becomes lower as being apart from each side of the one-end parts 18*a*.

Then, in the upper part at each side of the other-end parts 18*b* of the right and left second brackets 18R and 18L, a sheet loading tray lock groove 18*b*1, a curved cam part 18*b*2 (R part), a first straight-line inclination part 18*b*3, a sheet loading tray support groove 18*b*4, a first horizontal straight-line part 18*b*5, a second horizontal straight-line part 18*b*6, and a second straight-line inclination part 18*b*7 are sequentially formed from each side of the one-end parts 18*a* to each of the other-end back parts.

An upper part of the sheet loading tray lock groove 18*b*1 is formed such that there can be inserted/detached the lock pin 17 (FIGS. 2, 3, 5A, and 5B) laterally provided on each of the right and left first brackets 14R and 14L (FIGS. 2, 3, 5A, and 5B, with an upper part close to each side of the one-end parts 18*a* being opened In addition, the curved cam part 18*b*2 is formed in a curved shape (R-like shape) from the sheet loading tray lock groove 18*b*1 toward the first straight-line inclination part 18*b*3 located below the curved cam part 18*b*2, and thus there can be slid the lock pin 17 laterally provided in the right and left first brackets 14R and 14L.

Furthermore, the first straight-line inclination part 18*b*3 is formed in a straight form in a manner to be inclined toward the sheet loading tray support groove 18*b*4 located below the first straight-line inclination part 18*b*3.

Moreover, the sheet loading tray support groove 18*b*4 is formed such that the rotational pin 16 (FIGS. 2, 3, 5A, 5B) laterally provided in the right and left first brackets 14R and 14L can be inserted/detached, with an upper part away from each side of the one-end parts 18*a* being opened.

In addition, the first horizontal straight-line part 18*b*5 is horizontally formed from a leading end of the sheet loading tray support groove 18*b*4.

Furthermore, the second horizontal straight-line part 18*b*6 is horizontally formed one step lower than the first horizontal straight-line part 18*b*5. As described below, when the sheet loading tray 11 reaches the sheet loading position, the lock pin 17 laterally provided on each of the right and left first brackets 14R and 14L can be saved above the second horizontal straight-line part 18*b*6.

Moreover, the second straight-line inclination part 18*b*7 is inclined downwardly from the second horizontal straight-line part 18*b*6 to be formed up to the other-end back part.

In addition, the lower part of each side of the other-end parts 18*b* of the right and left second brackets 18R and 18L protrudes more downwardly than the lower part of each side of the one-end parts 18*a*, and furthermore, the stopper pin 20 is laterally provided, inwardly, at a lower central inside of each side of the other-end parts 18*b*.

Then, the right and left second brackets 18R and 18L also use the same components to reduce the number of the components. However, the stopper pin 20 is laterally provided, inwardly, and thus the right and left second brackets 18R and 18L are fixed in a horizontally non-symmetrical manner on each inside surface of the right and left frame members 2R and 2L as illustrated in FIG. 3.

Actions of the sheet loading device 10 according to the present invention configured as described above will be described by the use of FIGS. 7 to 10.

Note that, in FIGS. 7 to 10, only a left side surface of the sheet loading device 10 will be illustrated and described, and a right side surface thereof will not be described.

Figure 7:
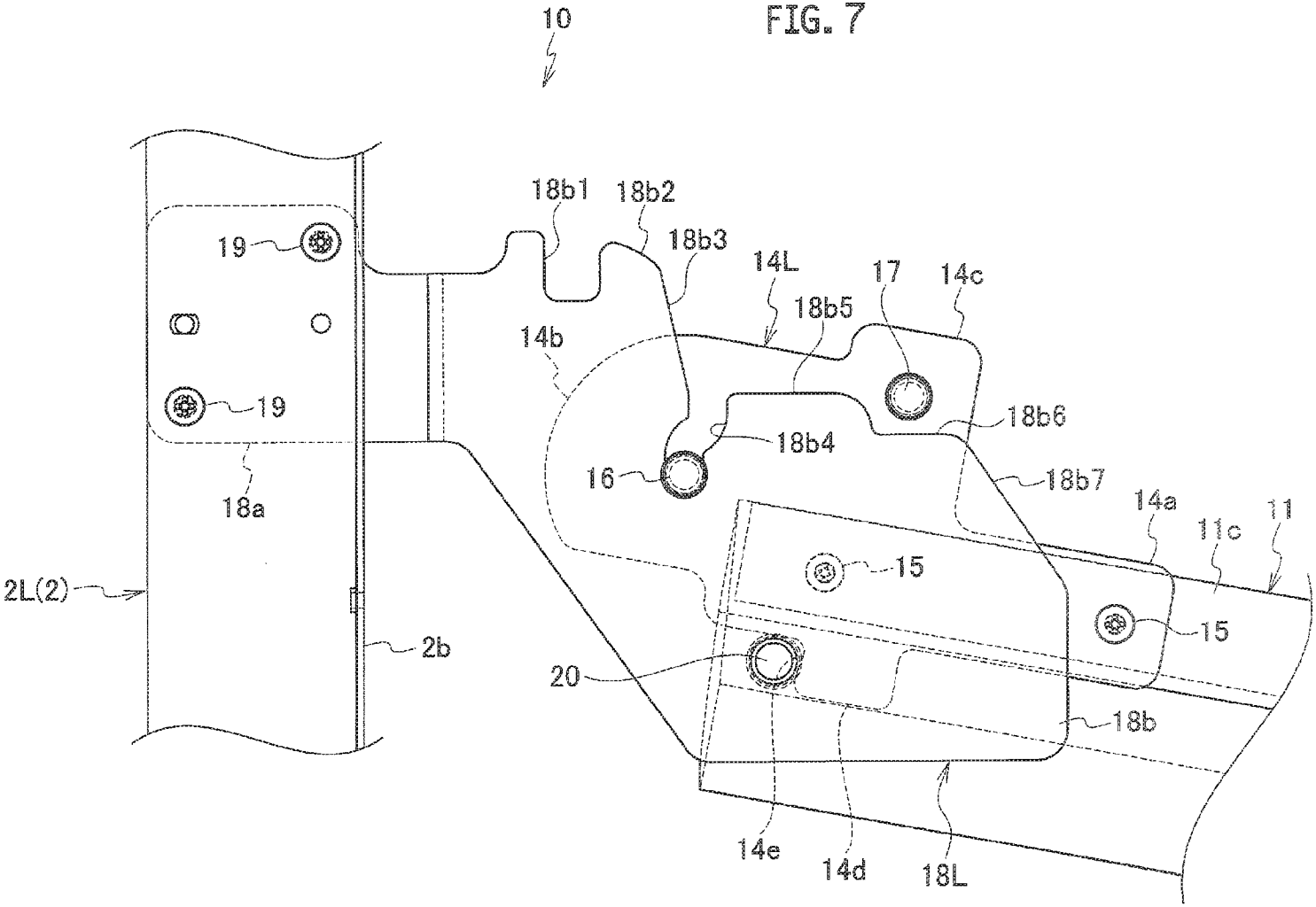
FIG. 7 is a diagram illustrating a first state of the sheet loading device according to the present invention.

First, FIG. 7 illustrates a first state of the sheet loading device 10 according to the present invention. As illustrated in FIGS. 2 and 3, the first state refers to a state where the sheet loading tray 11 reaches the sheet loading position.

Namely, a one-end part 14*a* of the left first bracket 14L is fixed to the side surface 11*c* of the sheet loading tray 11 by the use of two screws 15, and further, a one-end part 18*a* of the left second bracket 18L is fixed to the inside surface of the left frame member 2L vertically provided on the left side of the one side surface 2*b* of the casing 2 by the use of two screws 19.

In addition, the rotational pin 16 with leading end flange part laterally provided in the other-end part 14*b* of the left first bracket 14L is inserted from above to thereby rotatably fit into the sheet loading tray support groove 18*b*4 formed at the upper part of the side of the other-end part 18*b* of the left second bracket 18L.

Note that the leading end flange part formed on the rotational pin 16 is meshed with the upper part of the left second bracket 18L in the sheet loading tray support groove 18*b*4. With this arrangement, the rotational pin 16 is prevented from being horizontally pulled out.

Furthermore, the stopper pin 20 laterally provided in the lower central inside on the side of the other-end part 18*b* of the left second bracket 18L is engaged with the concave part 14*e* for engaging the stopper pin formed at a side facing the one side surface 2*b* of the casing 2 at the intermediate lower part 14*d* of the left first bracket 14L.

With this arrangement, since the sheet loading tray 11 is inclined up to an angle with which the sheet loading tray 11 is located slightly lower than the horizontal line with respect to the one side surface 2*b* of the casing 2 to thereby be supported at the sheet loading position, the sheet P can be loaded.

At this point, the lock pin 17 with leading end flange part laterally provided in the intermediate upper part 14*c* of the left first bracket 14L is saved above the second horizontal straight-line part 18*b*6 formed at the upper part of the side of the other-end part 18*b* of the left second bracket 18L.

Furthermore, when the sheet loading tray 11 reaches the sheet loading position, and when the sheet loading tray 11 is manually lifted and the rotational pin 16 laterally provided in the left first bracket 14L is pulled out from the sheet loading tray support groove 18*b*4 formed on the left second bracket 18L, the sheet loading tray 11 can be removed from the side of the one side surface 2*b* of the casing 2, with the sheet P loaded on the sheet loading tray 11.

Figure 8:
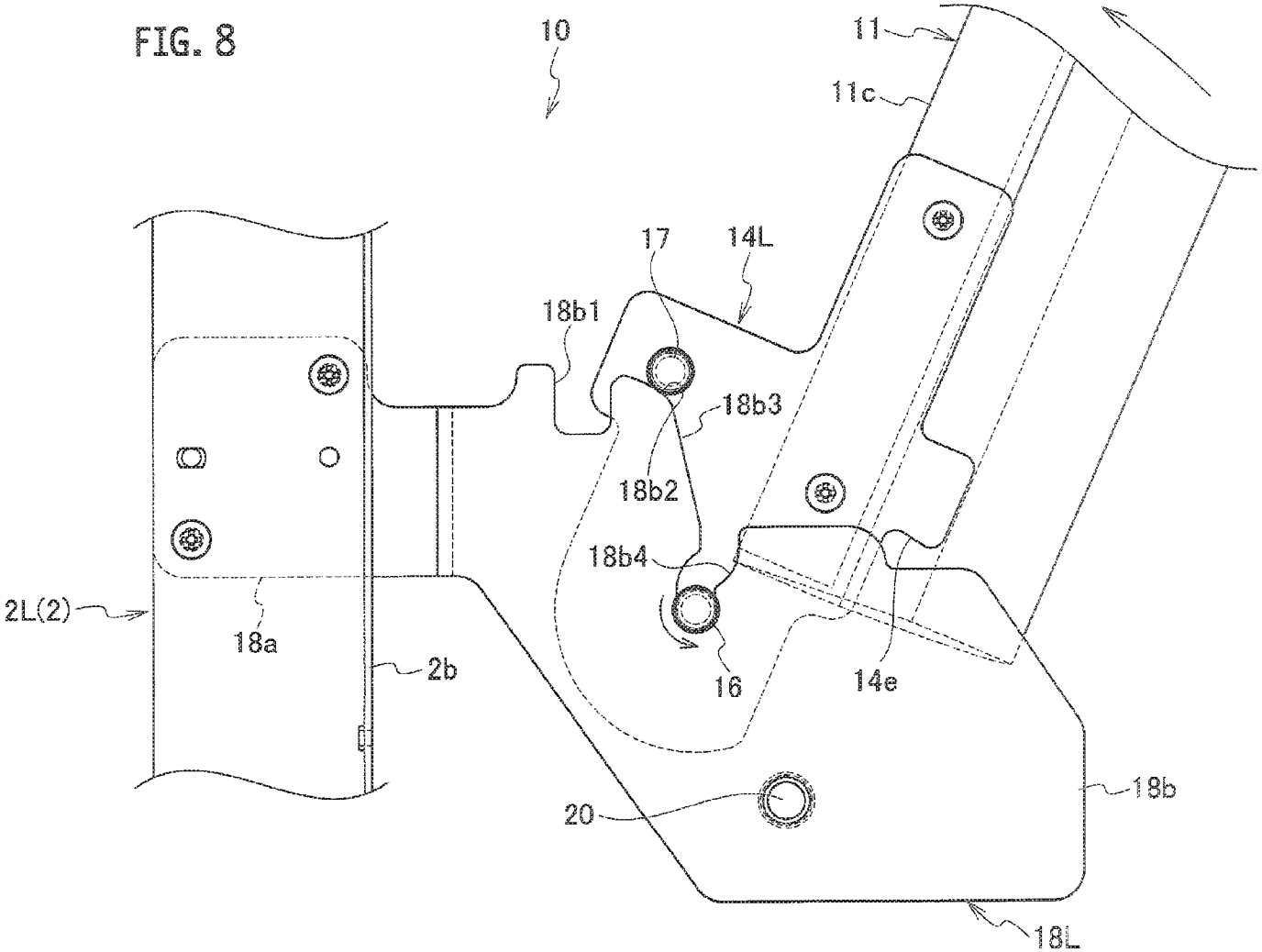
FIG. 8 is a diagram illustrating a second state of the sheet loading device according to the present invention.

Next, FIG. 8 illustrates a second state of the sheet loading device 10 according to the present invention. In the second state, after the sheet P loaded on the sheet loading tray 11 is removed at the sheet loading position, the sheet loading tray 11 is in a state of being rotated toward the side of the one side surface 2*b* of the casing 2.

Namely, in the second state, the sheet loading tray 11 is rotated counterclockwise about the rotational pin 16 fitted into the sheet loading tray support groove 18*b*4 formed on the left second bracket 18L, toward the side of the one side surface 2*b* of the casing 2 from the sheet loading position, and accordingly, the lock pin 17 laterally provided in the left first bracket 14L comes into contact with the curved cam part 18*b*2 formed on the upper part of the side of the other-end part 18*b* of the left second bracket 18L.

Then, when the lock pin 17 comes into contact with the curved cam part 18*b*2, a rotational center of the sheet loading tray 11 moves from the rotational pin 16 to the lock pin 17.

In addition, along with the counterclockwise rotation of the sheet loading tray 11, the stopper pin 20 laterally provided in the left second bracket 18L separates away from the concave part 14*e* for engaging the stopper pin formed on the left first bracket 14L.

Figure 9:
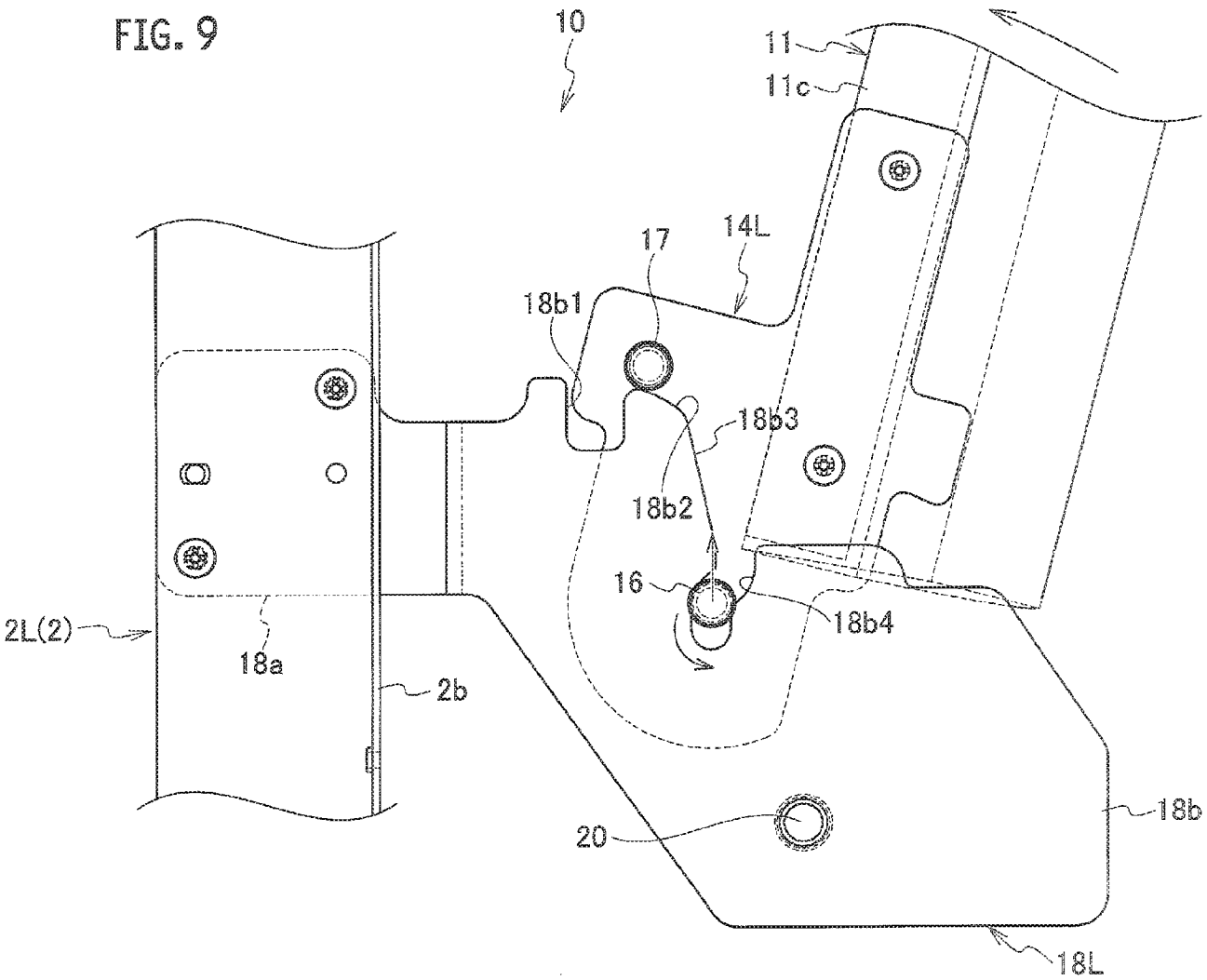
FIG. 9 is a diagram illustrating a third state of the sheet loading device according to the present invention.

Subsequently, FIG. 9 illustrates a third state of the sheet loading device 10 according to the present invention. In the third state, the sheet loading tray 11 is further rotated toward the side of the one side surface 2*b* of the casing 2 than the second state.

Namely, in the third state, a rotational center of the sheet loading tray 11 has moved from the rotational pin 16 to the lock pin 17. When the sheet loading tray 11 is further rotated in the counterclockwise direction, the lock pin 17 is moved to a side of a top point while sliding on the curved cam part 18*b*2 formed in the left second bracket 18L. Therefore, the rotational pin 16 fitted into the sheet loading tray support groove 18*b*4 formed in the left second bracket 18L comes off.

Figure 10:
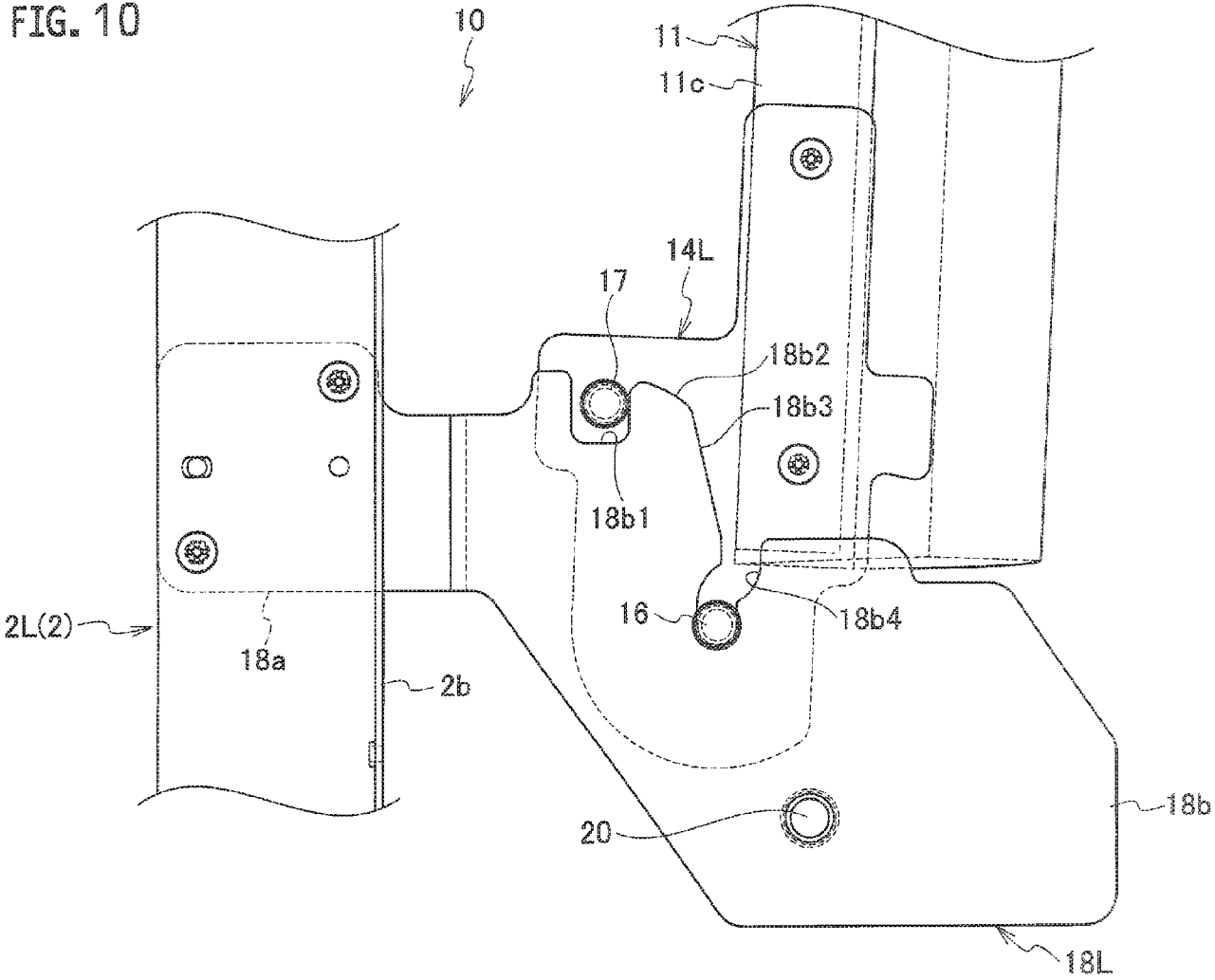
FIG. 10 is a diagram illustrating a fourth state of the sheet loading device according to the present invention.

Next, FIG. 10 illustrates a fourth state of the sheet loading device 10 according to the present invention. In the fourth state, as illustrated in FIG. 4, the sheet loading tray 11 reaches the sheet loading tray storage position.

Namely, when the rotational pin 16 comes off from an inside of the sheet loading tray support groove 18*b*4 formed on the left second bracket 18L, the lock pin 17 enters the sheet loading tray lock groove 18*b*1 from the side of the top point of the curved cam part 18*b*2 formed on the left second bracket 18L to thereby be locked and held in the sheet loading tray lock groove 18*b*1.

Note that the leading end flange part formed on the lock pin 17 is meshed with the upper part of the left second bracket 18L in the sheet loading tray lock groove 18*b*1. With this arrangement, the lock pin 17 is prevented from horizontally coming off.

Between the sheet loading tray support groove 18*b*4 and the sheet loading tray lock groove 18*b*1, the left second bracket 18L is formed with the curved cam part 18*b*2 on which the lock pin 17 slides along with an action of rotating the sheet loading tray 11 toward the sheet loading tray storage position from the sheet loading position. Accordingly, the lock pin 17 slides on the curved cam part 18*b*2 formed on the left second bracket 18L, and thus can securely and smoothly enters the sheet loading tray lock groove 18*b*1 from the curved cam part 18*b*2. In addition, while the lock pin 17 slides the curved cam part 18*b*2, the rotational pin 16 comes off in the sheet loading tray support groove 18*b*4 and the sheet loading tray 11 is automatically lifted upward. Therefore, the lock pin 17 easily enters the sheet loading tray lock groove 18*b*1.

Furthermore, when the lock pin 17 enters the sheet loading tray lock groove 18*b*1, the rotational pin 16 does not come off, and is securely fitted into the sheet loading tray support groove 18*b*4 again. The sheet loading tray 11 reaches the sheet loading tray storage position in a state of being erected substantially vertically facing the side of the one side surface 2*b* of the casing 2.

According to the sheet loading device of the present invention described above in detail, when the sheet loading tray 11 loading the plurality of sheets P is rotatably and detachably configured between the sheet loading position and the sheet loading tray storage position on the side of the one side surface 2*b* of the casing 2 of the image forming apparatus 1, the rotational pin 16 and the lock pin 17 are laterally provided in the right and left first brackets 14R and 14L that are fixed to the right and left side surfaces 11*d* and 11*c* of the sheet loading tray 11 respectively, and furthermore, the right and left second brackets 18R and 18L are fixed to the right and left of the one side surfaces 2*b* of the casing 2. When the sheet loading tray 11 reaches the sheet loading position, the lock pin 17 is made to enter the sheet loading tray lock groove 18*b*1 formed on the right and left second brackets 18R and 18L to thereby lock and hold the sheet loading tray 11 at the sheet loading tray storage position, along with an action of rotating the sheet loading tray 11 about the rotational pin 16 fitting into the sheet loading tray support groove 18*b*4 formed on the right and left second brackets 18R and 18L from the sheet loading position to the sheet loading tray storage position.

As a result, it becomes unnecessary to provide a magnet for holding the sheet loading tray 11 in a state of being erected substantially vertically at the sheet loading tray storage position. Since components including a magnet, a magnet mounting plate, and a magnet adsorbing plate for holding the sheet loading tray 11 in the state of being erected substantially vertically at the sheet loading tray storage position are not necessary, the number of components constituting the entire sheet loading device can be reduced.

Furthermore, an unusual action during a series of actions for rotating the sheet loading tray 11 from the sheet loading position to the sheet loading tray storage position is not necessary. During a normal rotational action, the lock pin 17 laterally provided on the right and left first brackets 14R and 14L fixed to the right and left side surfaces 11*d*, 11*c* of the sheet loading tray 11 is made to enter the sheet loading tray lock groove 18*b*1 formed on the right and left second brackets 18R and 18L fixed to the right and left of the one side surface 2*b* of the casing 2. Thus, since the sheet loading tray 11 is securely locked and held while keeping a posture of being erected at the sheet loading tray storage position, the sheet loading tray 11 can be prevented from sudden falling, thereby not causing danger and not causing fear of breaking components.

Moreover, loading of the sheet loading tray 11 can be dispersed to four pins 16, 17 in the right and left at the sheet loading tray storage position, and can be received with the right and left second brackets 18R and 18L.

As described above, the present invention is not limited to the above described embodiment as it is, but the components can be modified and embodied within the scope not deviating from its gist in a practical stage. Further, by appropriate combination of plurality of components disclosed in the embodiment, various kinds of inventions can be formed. For example, some components may be deleted from all components described in the embodiment.

The present application claims the priority based on the Japanese Patent Application No. 2016-101075 filed on 20 May 2016, and all contents of the present application is incorporated into the present specification as reference.

REFERENCE SIGNS LIST

1 image forming apparatus
2 casing
2*a* top face
2*b* one side surface
2*b*1 first opening part
2*c* other side surface
2*c*1 second opening part
3 operation panel
6 paper feed unit
7 image forming unit
8 paper discharge unit
9 controller
10 sheet loading device
11 sheet loading tray
11*a* upper surface
11*b* front side surface
11*c*, 11*d* left side surface, right side surface
12 end fence plate
13L, 13R a pair of right and left side fence plates
14L, 14R a pair of right and left first brackets
14*a* one-end part
14*b* other-end part
14*c* intermediate upper part
14*d* intermediate lower part
14*e* concave part for locking stopper pin
15 screw
16 rotational pin with leading end flange part
17 lock pin with leading end flange part
18L, 18R right second bracket, left second bracket
18*a* one-end part
18*b* other-end part
18*b*1 sheet loading tray lock groove
18*b*2 curved cam part (R part)
18*b*3 first straight-line inclination part
18*b*4 sheet loading tray support groove
18*b*5 first horizontal straight-line part
18*b*6 second horizontal straight-line part
18*b*7 second straight-line inclination part
19 screw
20 stopper pin
P sheet

What is claimed is:

1. A sheet loading device in which a sheet loading tray that loads a plurality of sheets, between a sheet loading position where the sheet loading tray is inclined outwardly from a one side surface of a casing of an image forming apparatus to load the sheet and a sheet loading tray storage position where the sheet loading tray is erected along the one side surface to be stored, is rotatably mounted on a side of the one side surface of the casing, and furthermore, the sheet loading tray is detachable from the side of the one side surface at the sheet loading position, the sheet loading device comprising:

right and left first brackets whose each side of one-end parts is fixed to each outside of right and left side surfaces on a side of a front side surface of the sheet loading tray facing the one side surface of the casing, and whose each side of other-end parts protrudes toward the one side surface thereof;

a lock pin laterally provided on each side of one-end parts of the right and left first brackets;

a rotational pin laterally provided on each side of other-end parts of the right and left first brackets right and left second brackets whose each side of one-end parts is fixed to each of right and left one side surfaces of the casing, and whose each side of other-end parts protrudes toward each of right and left side surface sides of the sheet loading tray;

a sheet loading tray lock groove into/from which the each lock pin is inserted/detached with an upper part close to each side of one-end parts being opened in an upper part of each side of the other end parts of the right and left second brackets, and a sheet loading support groove into/from which the each rotational pin is inserted/detached with an upper part away from each side of one-end parts being opened in an upper part of each side of the other end parts of the right and left second brackets, wherein, when the sheet loading tray reaches the sheet loading position, the lock pin is made to enter the sheet loading tray lock groove formed on the right and left second brackets to lock and hold the sheet loading tray at the sheet loading tray storage position, along with an action of rotating the sheet loading tray about the rotational pin fitting into the sheet loading tray support groove formed on the right and left second brackets from the sheet loading position to the sheet loading tray storage position.

2. The sheet loading device according to claim 1, wherein, between the sheet loading tray support groove and the sheet loading tray lock groove, the right and left second brackets are formed with each curved cam part on which the lock pin slides along with an action of rotating the sheet loading tray from the sheet loading position to the sheet loading tray storage position.

* * * * *